US008998119B2

(12) United States Patent
Zhan

(10) Patent No.: US 8,998,119 B2
(45) Date of Patent: Apr. 7, 2015

(54) PAPER SHREDDER WITH ALLOWABLE THICKNESS WARNING FUNCTION

(71) Applicant: Primax Electronics Ltd., Taipei (TW)

(72) Inventor: Jian-Hua Zhan, Taipei (TW)

(73) Assignee: Primax Electronics Ltd., Taipei (TW)

( * ) Notice: Subject to any disclaimer, the term of this patent is extended or adjusted under 35 U.S.C. 154(b) by 343 days.

(21) Appl. No.: 13/659,609

(22) Filed: Oct. 24, 2012

(65) Prior Publication Data

US 2014/0042254 A1 Feb. 13, 2014

(30) Foreign Application Priority Data

Aug. 7, 2012 (CN) ..... 2012 1 0278638

(51) Int. Cl.

| | |
|---|---|
| ***B02C 25/00*** | (2006.01) |
| ***B02C 18/00*** | (2006.01) |
| ***B02C 18/22*** | (2006.01) |
| *B02C 18/16* | (2006.01) |

(52) U.S. Cl.

CPC ..... *B02C 18/0007* (2013.01); *B02C 18/2283* (2013.01); *B02C 2018/0038* (2013.01); *B02C 2018/0046* (2013.01); *B02C 2018/164* (2013.01)

(58) Field of Classification Search

CPC .... B02C 23/04; B02C 25/00; B02C 18/0007; B02C 18/2283; B02C 2018/164

USPC ..... 241/34, 36, 100, 101.3, 224, 225, 236

See application file for complete search history.

(56) References Cited

U.S. PATENT DOCUMENTS

| | | | | |
|---|---|---|---|---|
| 7,584,545 | B2 * | 9/2009 | Pan | 33/501.02 |
| 7,894,080 | B2 * | 2/2011 | Pan | 356/630 |
| 2006/0219827 | A1 * | 10/2006 | Matlin et al. | 241/30 |
| 2010/0243774 | A1 * | 9/2010 | Hu et al. | 241/30 |

* cited by examiner

*Primary Examiner* — Mark Rosenbaum

(74) *Attorney, Agent, or Firm* — Apex Juris, PLLC; Tracy M Heims

(57) ABSTRACT

A paper shredder with an allowable thickness warning function is provided. The paper shredder includes a casing and an upper cover. An input tray is disposed on the casing for placing plural papers thereon. A pressing member and a thickness detecting device are installed on the upper cover. When the pressing member is contacted with the plural papers on the input tray and pushed by the plural papers, the pressing member is moved. The thickness detecting device is located near the pressing member. Moreover, in response to the movement of the pressing member, the thickness detecting device may be triggered. If an overall thickness of the plural papers exceeds an allowable thickness, the pressing member is pushed by the plural papers. Consequently, the thickness detecting device is triggered by the pressing member to generate a warning signal.

11 Claims, 9 Drawing Sheets

PAPER SHREDDER WITH ALLOWABLE THICKNESS WARNING FUNCTION

FIELD OF THE INVENTION

The present invention relates to a paper shredder, and more particularly to a paper shredder with a function of feeding papers.

BACKGROUND OF THE INVENTION

Recently, as the security awareness is gradually increased, paper shredders are widely used in the offices of many companies. A paper shredder is an office machine used to cut a confidential paper document into plural small pieces (e.g. strips or fine particles) in order to prevent the confidential data of the document from being leaked. Generally, for most of the paper shredders, after the papers are manually fed into the paper shredders, the papers are cut into small pieces by the paper shredders. However, the number of papers that can be cut by the paper shredder is limited. If the number of papers exceeds the permissible paper number of the paper shredder at one time, the paper shredder is possibly jammed by too many papers or even the paper shredder has a breakdown or damage. For preventing from the breakdown or the damage of the paper shredder, the papers should be fed into the paper shredder in batches by the user. As known, the way of feeding the papers into the paper shredder in batches is time-consuming for the user. For solving the above drawbacks, a paper shredder with a function of feeding papers has been introduced into the market.

FIG. 1 is a schematic exploded view illustrating a conventional paper shredder with a function of feeding papers. As shown in FIG. 1, the conventional paper shredder 1 comprises a casing 10, an upper cover 11, an input tray 12, a shredding entrance 13, a feeding roller assembly 14, and a shredding knife assembly 15. The upper cover 11 is disposed on the casing 10. In addition, the upper cover 11 is rotatable relative to the casing 10 to be selectively opened or closed. When the upper cover 11 is closed, the casing 10 is covered by the upper cover 11. The upper cover 11 has a protrusion structure 111. When the casing 10 is covered by the upper cover 11, the protrusion structure 111 is coupled with the casing 10, so that the upper cover 11 is combined with the casing 10. The input tray 12 is disposed on the casing 10 for placing at least one paper (not shown) thereon. The shredding entrance 13 is disposed in the input tray 12 and located at a middle portion of the input tray 12. Through the shredding entrance 13, the at least one paper may be introduced into the casing 10. The feeding roller assembly 14 is disposed on the input tray 12, and located at bilateral sides of the shredding entrance 13. The feeding roller assembly 14 may be contacted with the at least one paper on the input tray 12 in order to feed the at least one paper into the shredding entrance 13. The shredding knife assembly 15 is accommodated within the casing 10 and disposed under the shredding entrance 13. When the at least one paper is transferred through the shredding entrance 13, the at least one paper is cut into small pieces by the shredding knife assembly 15. The casing 10 has a storage bin 101. The storage bin 101 may be slid relative to the casing 10 in order to be stored within the casing 10 or removed from the casing 10. When the storage bin 101 is stored within the casing 10, the storage bin 101 is disposed under the shredding knife assembly 15. Consequently, the small pieces of the at least one paper cut by the shredding knife assembly 15 are received within the storage bin 101.

The operations of the conventional paper shredder 1 with a function of feeding papers will be illustrated in more details as follows. After plural papers are placed on the input tray 12 of the paper shredder 1, the upper cover 11 is rotated relative to the casing 10 to have the upper cover 11 cover the casing 10, so that the upper cover 11 is combined with the casing 10 and the storage bin 101 is stored within the casing 10 (see FIG. 2). A way of placing plural papers S on the input tray 12 will be illustrated with reference to FIG. 3. FIG. 3 is a schematic perspective view illustrating the input tray of the conventional paper shredder. For clarification and brevity, only one paper S is shown on FIG. 3. In addition, the paper S is indicated as dotted lines.

Please refer to FIG. 3 again. As the feeding roller assembly 14 at the bilateral sides of the shredding entrance 13 is rotated, the papers which are contacted with the feeding roller assembly 14 will be fed by the feeding roller assembly 14. That is, the middle portion of the at least one paper S is contacted with the feeding roller assembly 14. The middle portion of the at least one paper S is firstly fed into the shredding entrance 13 by the feeding roller assembly 14. At the same time, the both ends of the at least one paper S are moved toward the shredding entrance 13. After the at least one paper S is introduced into the shredding entrance 13, the both ends of the at least one paper S are introduced into the shredding entrance 13. When the at least one paper S is transferred through the shredding entrance 13, the at least one paper S is cut into plural small pieces by the shredding knife assembly 15. Then, the plural small pieces fall down to the storage bin 101. After the plural papers on the input tray 12 are completely cut, the storage bin 101 may be removed from the casing 10, so that the plural small pieces within the storage bin 101 may be emptied by the user.

From the above discussions, the conventional paper shredder 1 with the paper feeding function can accommodate plural papers and cut the papers into plural small pieces. By simply placing plural papers on the input tray 12, the plural papers can be sequentially fed into the paper shredder 1 without the need of being fed in batches. However, the number of papers permissible to be accommodated within the input tray 12 of the conventional paper shredder 1 at one time is limited. In addition, the conventional paper shredder 1 has no function of prompting the user whether the overall thickness of the plural papers on the input tray 12 exceeds the maximum allowable thickness of the input tray 12. If the overall thickness of the plural papers on the input tray 12 exceeds the maximum allowable thickness of the input tray 12, the upper cover 11 is only able to cover the casing 10 but unable to be combined with the casing 10 because the overall thickness of the plural papers is too large. Under this circumstance, the user needs to exert an additional external force on the upper cover 11 in order to combine the upper cover 11 with the casing 10. After a long use time period, the upper cover 11 is readily fractured and the input tray 12 is possibly suffered from deformation in response to the external force. Since the feeding roller assembly 14 is disposed on the input tray 12, the operations of the feeding roller assembly 14 are adversely affected by the deformation of the input tray 12.

Therefore, there is a need of providing a paper shredder with an allowable thickness warning function.

SUMMARY OF THE INVENTION

The present invention provides a paper shredder with an allowable thickness warning function.

In accordance with a first aspect of the present invention, there is provided a paper shredder with an allowable thickness warning function for cutting plural papers. The paper shredder includes a casing, an input tray, a shredding entrance, an upper cover, a pressing member, and a thickness detecting device. The input tray is disposed on the casing for placing the plural papers thereon. The shredding entrance is disposed in the casing and located at a bottom of the input tray. The plural papers on the input tray are introduced into the casing through the shredding entrance. The upper cover is disposed over the casing, and rotatable relative to the casing. The pressing member is disposed on a bottom of the upper cover and movable upwardly and downwardly relative to the upper cover. When the upper cover is rotated relative to the casing to cover the casing, the pressing member is contacted with the plural papers on the input tray and the pressing member is pushed by the plural papers. The thickness detecting device is disposed within the upper cover and located near the pressing member. If an overall thickness of the plural papers exceeds an allowable thickness, the pressing member is pushed by the plural papers, so that the thickness detecting device is triggered by the pressing member to generate a warning signal.

In an embodiment, the paper shredder further includes a warning module. The warning module is electrically connected with the thickness detecting device. In response to the warning signal, the warning module generates a warning message.

In an embodiment, the warning module is an indicating lamp, a display screen or a sound-generating device. The warning message is a flickering light generated by the indicating lamp, a text message shown on the display screen or a warning sound generated by the sound-generating device.

In an embodiment, the pressing member includes a pressing plate and at least one connecting post. The pressing plate is disposed under the bottom of the upper cover to be contacted with the plural papers on the input tray and pushed by the plural papers. The at least one connecting post is disposed on the bottom of the upper cover and connected with the pressing plate. Moreover, the pressing plate is movable upwardly and downwardly relative to the upper cover to trigger the thickness detecting device.

In an embodiment, the thickness detecting device is a micro switch.

In an embodiment, the thickness detecting device includes a light emitter and a light receiver. The light emitter is located at a first side of the at least one connecting post for generating a light beam. The light receiver is located at a second side of the at least one connecting post for receiving the light beam.

In an embodiment, the paper shredder further includes a shredding channel, a feeding roller assembly, a shredding knife assembly, and a driving device. The shredding channel is disposed under the shredding entrance for allowing the plural papers to go through. The feeding roller assembly is located at bilateral sides of the shredding entrance. When the feeding roller assembly is contacted with the plural papers on the input tray, the plural papers are fed into the shredding entrance by the feeding roller assembly. The shredding knife assembly is disposed in the shredding channel for cutting the plural papers which are transferred through the shredding channel. The driving device is disposed within the casing and connected with the feeding roller assembly, the shredding knife assembly and the thickness detecting device for providing a motive power to the feeding roller assembly and the shredding knife assembly.

In an embodiment, when the thickness detecting device is triggered to generate the warning signal, the driving device stops providing the motive power in response to the warning signal, so that the feeding roller assembly and the shredding knife assembly are disabled.

In an embodiment, a middle portion of a bottommost paper of the plural papers on the input tray is contacted with the feeding roller assembly. After the feeding roller assembly is rotated by acquiring the motive power, the middle portion of the bottommost paper is firstly introduced into the shredding entrance by the feeding roller assembly, then an end of the bottommost paper is fed by the feeding roller assembly to be moved toward the shredding entrance, and finally the end of the bottommost paper is introduced into the shredding entrance.

In an embodiment, the casing further includes a receiving space and a door. The receiving space is disposed under the shredding channel. The plural papers are cut into plural small pieces. A storage box for storing the small pieces of the cut papers, the storage bag for storing the small pieces of the cut papers or the small pieces of the cut papers are accommodated within the receiving space. The door is disposed on the casing. By rotating the door relative to the casing, the receiving space is selectively exposed or unexposed.

In an embodiment, the upper cover includes an external entrance, which is exposed outside the upper cover. At least one paper of the plural papers outside the upper cover is introduced into the shredding entrance through the external entrance.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
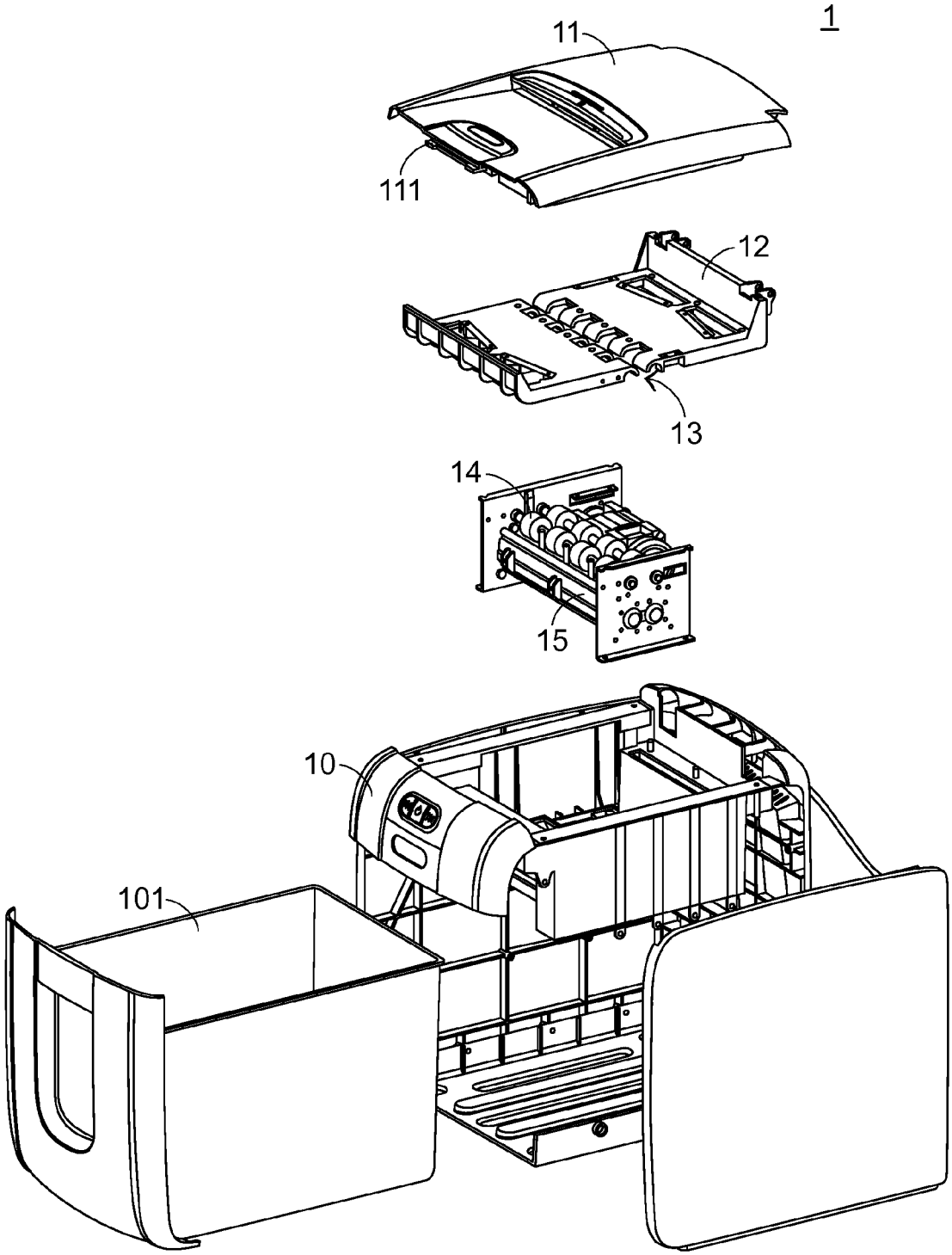
FIG.1 PRIOR ART
FIG. 1 is a schematic exploded view illustrating a conventional paper shredder with a function of feeding papers.
Figure 2:
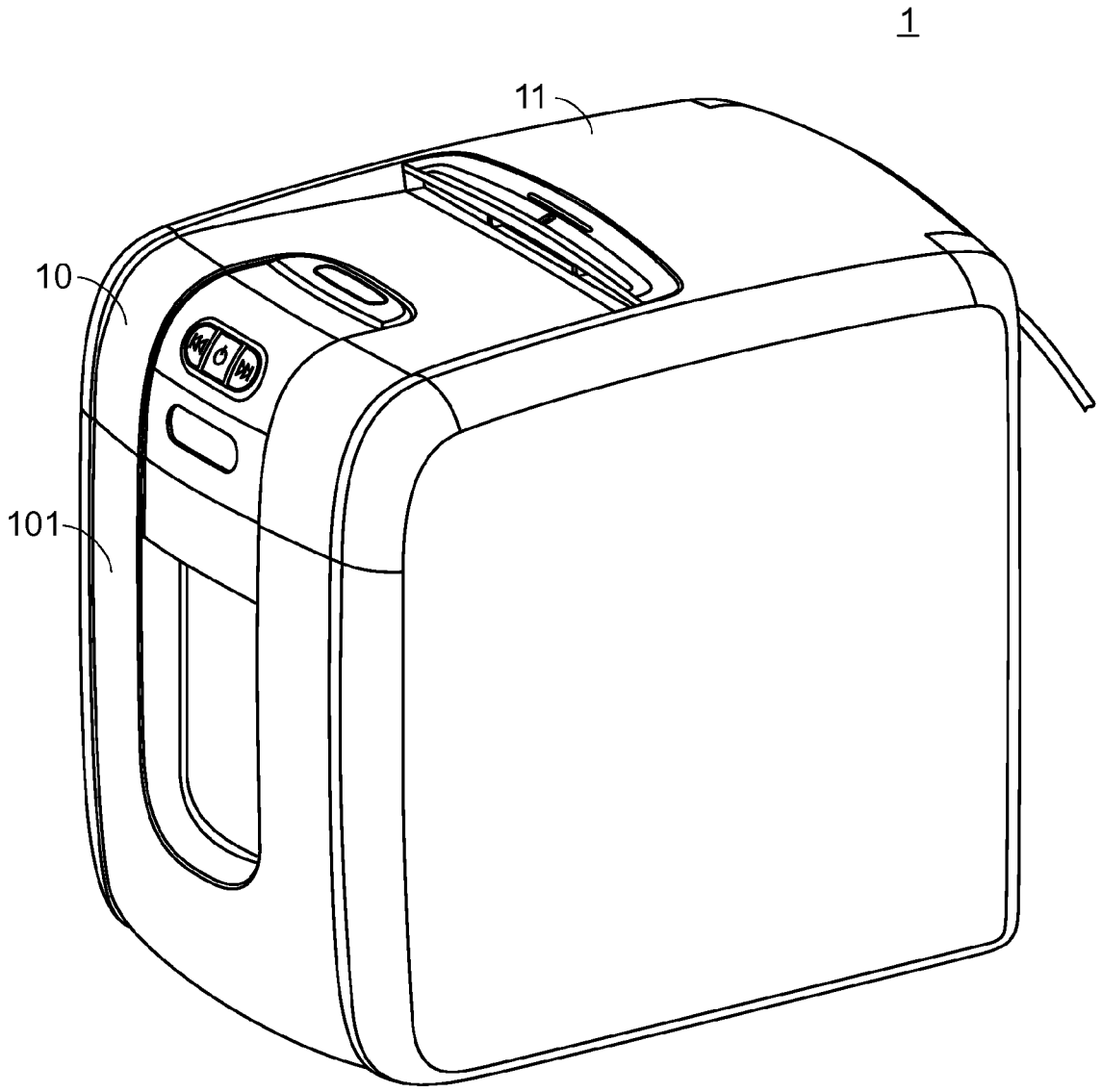
FIG.2 PRIOR ART
FIG. 2 is a schematic perspective view illustrating the outward appearance of the conventional paper shredder.
Figure 3:
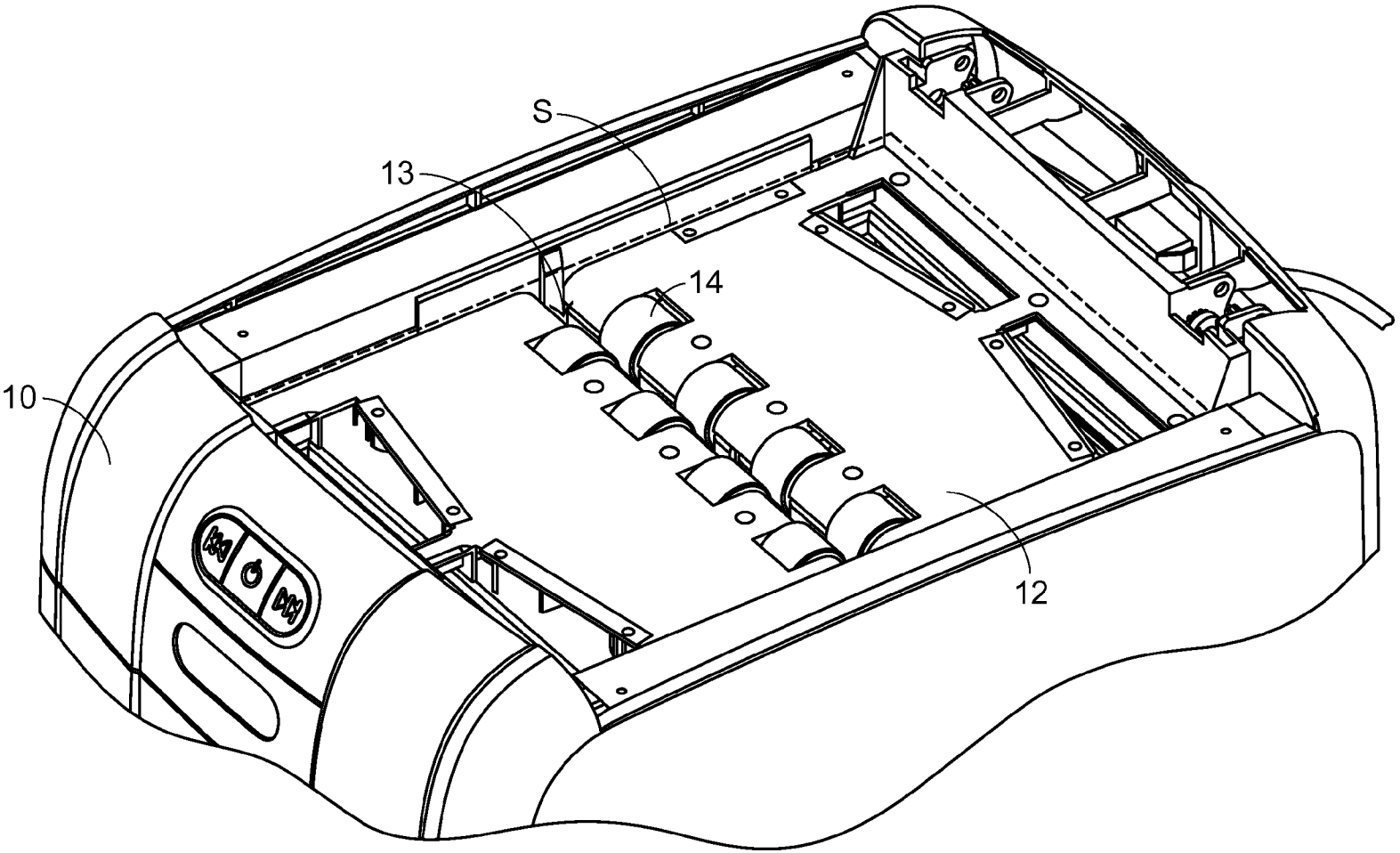
FIG.3 PRIOR ART
FIG. 3 is a schematic perspective view illustrating the input tray of the conventional paper shredder.
Figure 4:
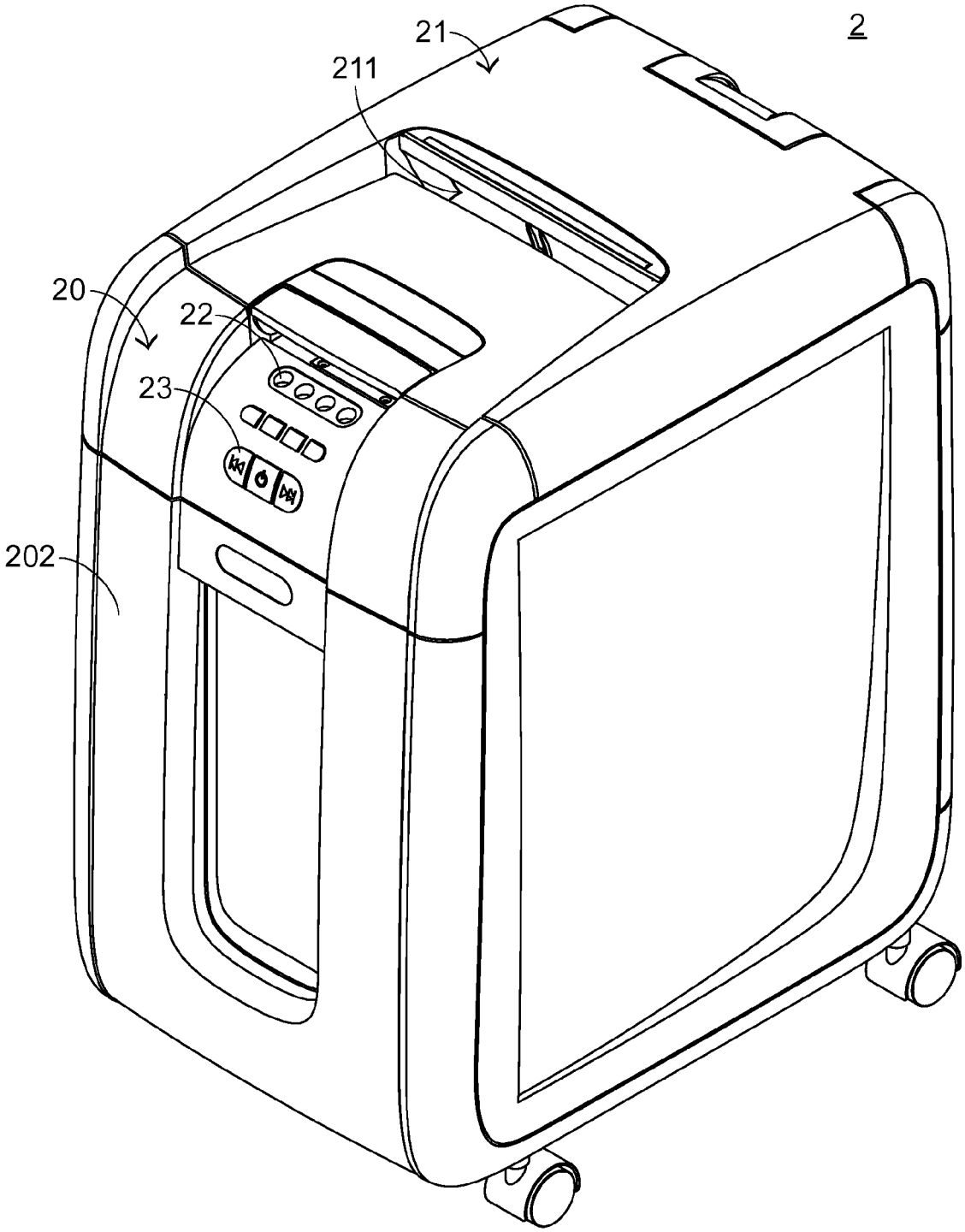
FIG. 4 is a schematic perspective view illustrating the outward appearance of a paper shredder with an allowable thickness warning function according to an embodiment of the present invention.
Figure 5:
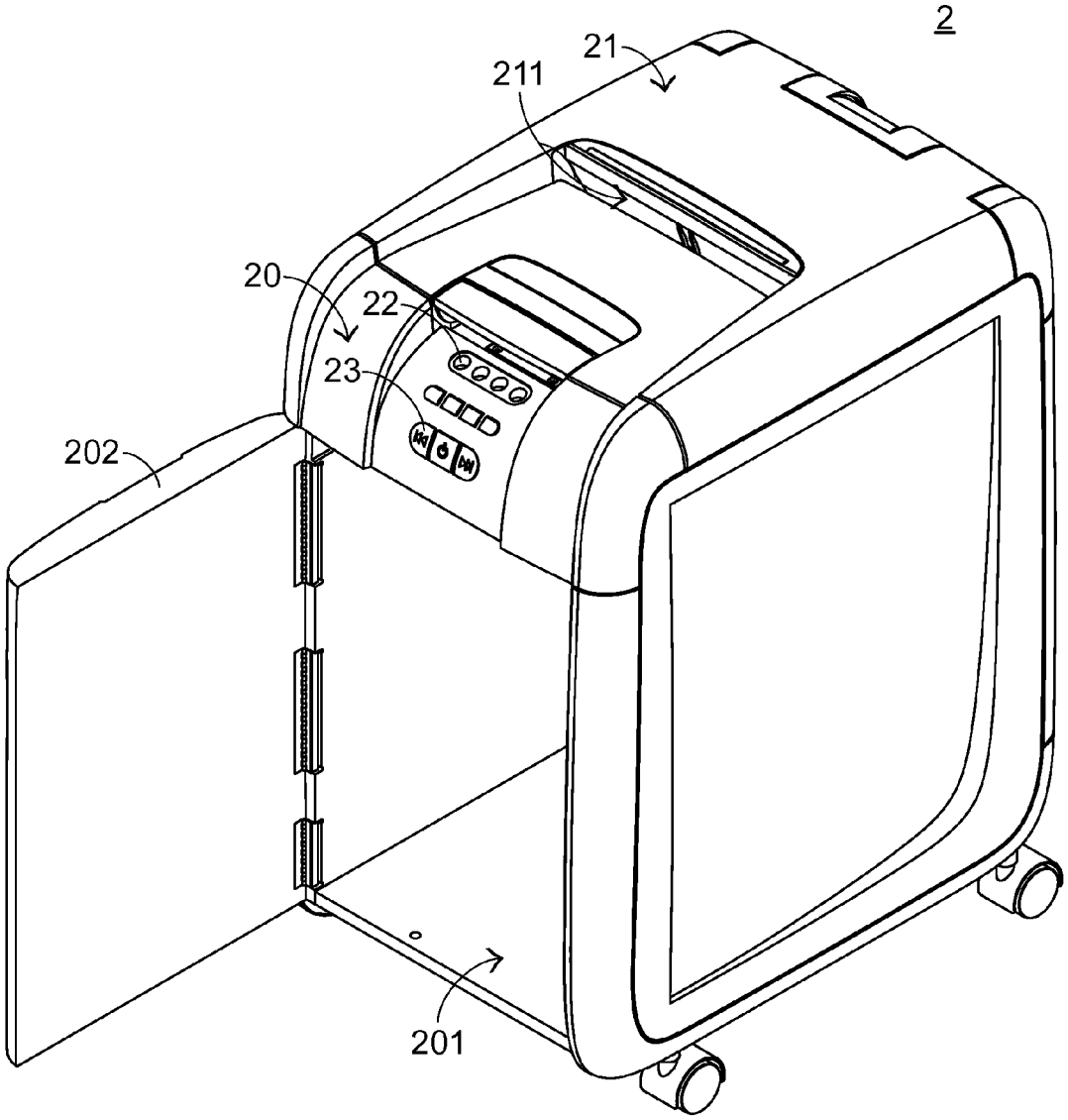
FIG. 5 is a schematic perspective view illustrating the paper shredder of FIG. 4, in which the door of the paper shredder is opened.

The present invention provides a paper shredder with an allowable thickness warning function. FIG. 4 is a schematic perspective view illustrating the outward appearance of a paper shredder with an allowable thickness warning function according to an embodiment of the present invention. FIG. 5 is a schematic perspective view illustrating the paper shredder of FIG. 4, in which the door of the paper shredder is opened. Please refer to FIGS. 4 and 5. The paper shredder 2 is used for cutting plural papers (not shown). Moreover, the paper shredder 2 comprises a casing 20, an upper cover 21, a warning module 22, and plural operating buttons 23. The casing 20 comprises a receiving space 201 and a door 202. The receiving space 201 is used for accommodating plural small pieces of the cut papers, a storage box (not shown) or a storage bag (not shown). The storage box and the storage bag are used for storing the plural small pieces of the cut papers. The door 202 is disposed on the casing 20. By rotating the door 202 relative to the casing 20 to expose the receiving space 201, the articles (e.g. the plural small pieces of the cut papers, the storage box or the storage bag) within the receiving space 201 can be taken out by the user. Alternatively, by rotating the door 202 relative to the casing 20 to shelter the receiving space 201, the articles within the receiving space 201 are not exposed. In some embodiments, the door on the casing 20 may be integrally formed with the storage element (e.g. the storage bin 101 as shown in FIG. 1).

The upper cover 21 is disposed over the casing 20. In addition, the upper cover 21 may be rotated relative to the casing 20 to be opened. In this embodiment, the upper cover 21 comprises an external entrance 211, which is exposed outside the upper cover 21. Through the external entrance 211, the papers outside the upper cover 21 may be directly placed into the paper shredder 2 by the user. The warning module 22 and the plural operating buttons 23 are all disposed on the casing 20. By operating the plural operating buttons 23, corresponding functions of the paper shredder 2 can be implemented. The functions and operations of the warning module 22 will be illustrated later.

Figure 6:
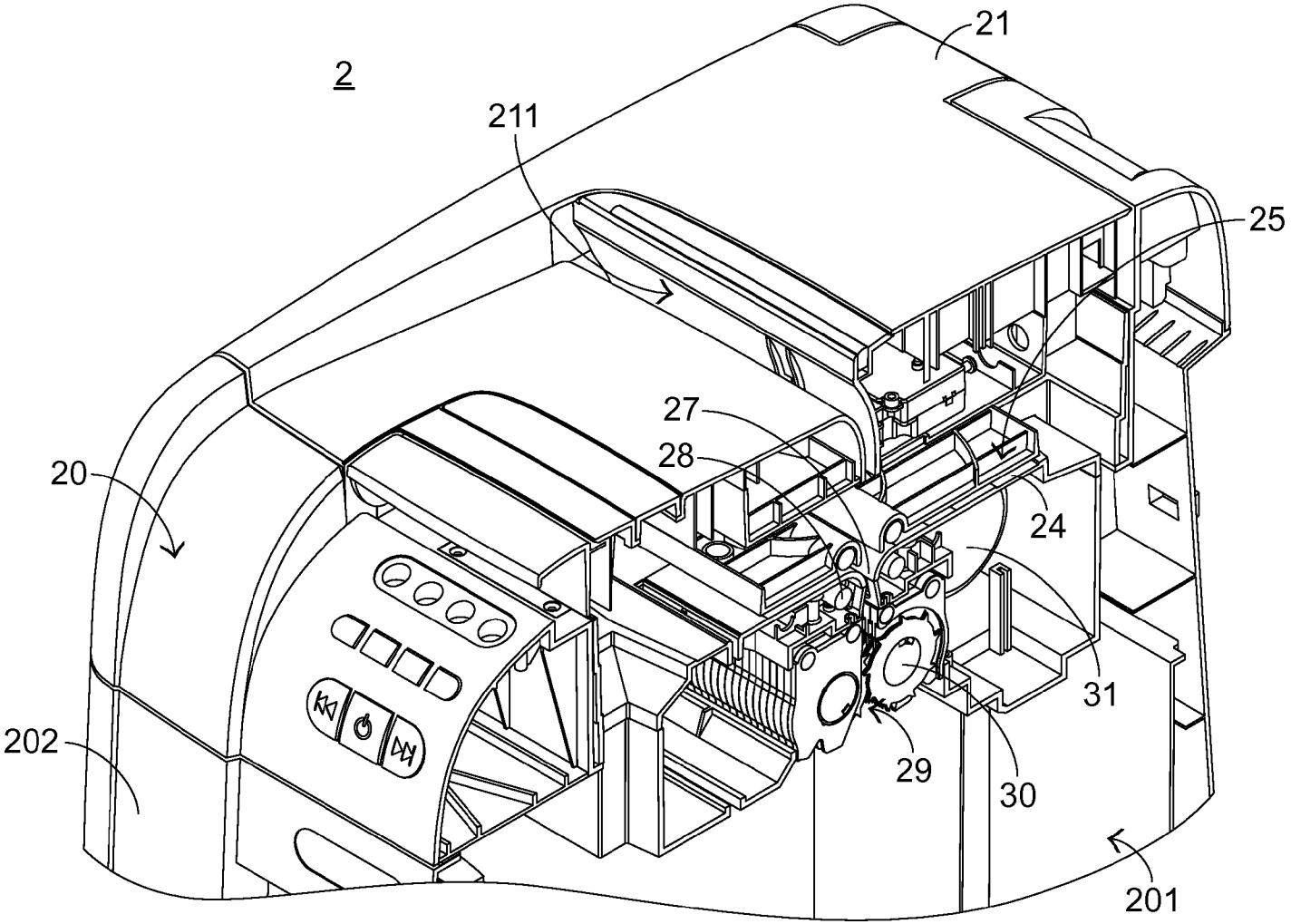
FIG. 6 is a schematic partial cutaway view illustrating the paper shredder according to the embodiment of the present invention.
Figure 7:
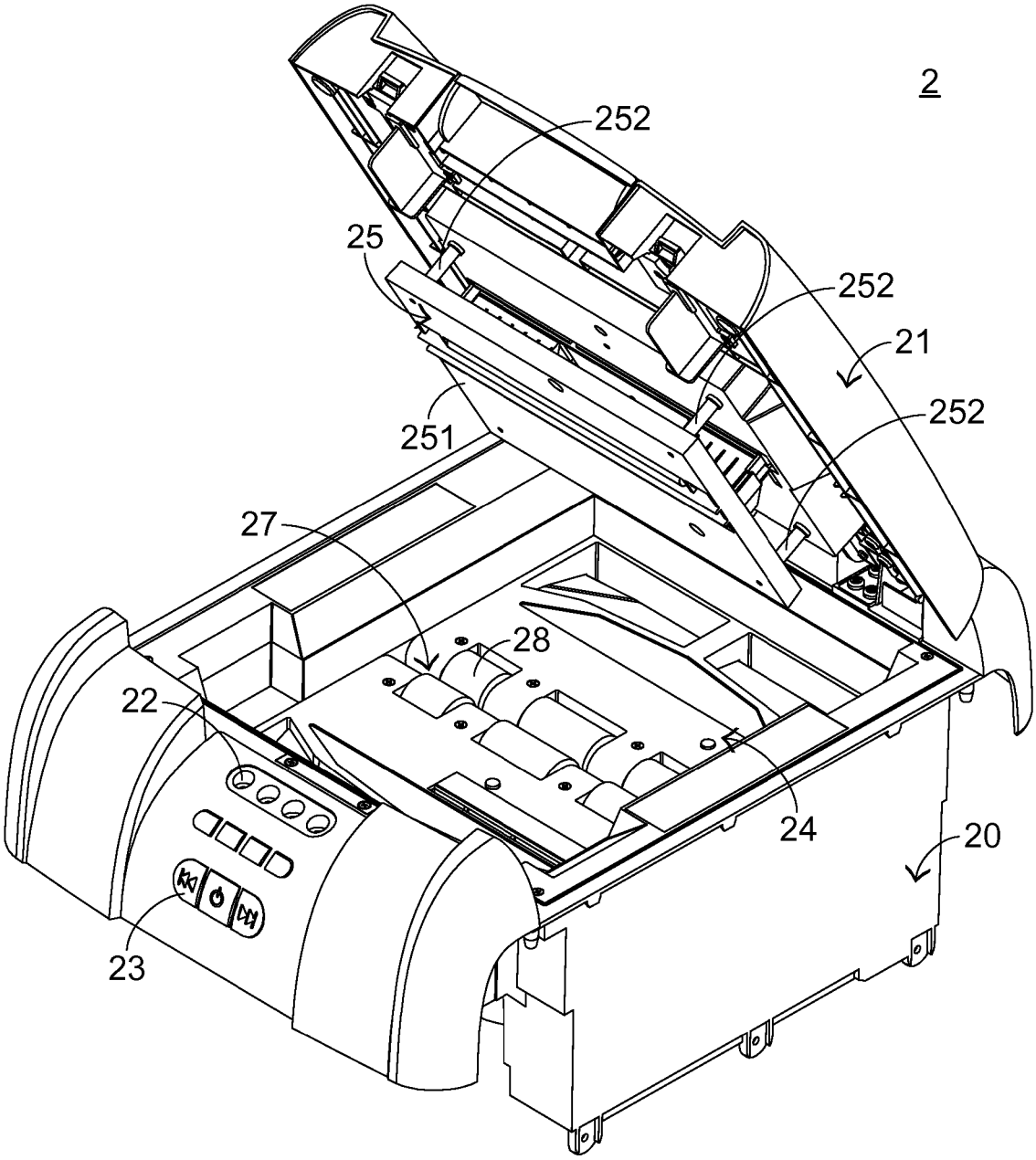
FIG. 7 is a schematic partial perspective view illustrating the paper shredder according to the embodiment of the present invention, in which the upper cover is uplifted.

FIG. 6 is a schematic partial cutaway view illustrating the paper shredder according to the embodiment of the present invention. FIG. 7 is a schematic partial perspective view illustrating the paper shredder according to the embodiment of the present invention, in which the upper cover is uplifted. Please refer to FIGS. 6 and 7. In addition to the casing 20, the upper cover 21, the warning module 22 and the plural operating buttons 23, the paper shredder 2 of the present invention further comprises an input tray 24, a pressing member 25, a thickness detecting device 26 (see FIG. 8), a shredding entrance 27, a feeding roller assembly 28, a shredding channel 29, a shredding knife assembly 30, and a driving device 31. The input tray 24 is disposed on the casing 20, wherein plural papers to be cut are placed on the input tray 24. The shredding entrance 27 is disposed in the casing 20 and located at a bottom of the input tray 24. Through the shredding entrance 27, the plural papers on the input tray 24 may be introduced into the shredding channel 29 within the casing 20.

The feeding roller assembly 28 is located at bilateral sides of the shredding entrance 27. The feeding roller assembly 28 is contacted with the plural papers on the input tray 24 in order to feed the papers into the shredding entrance 27. The shredding channel 29 is disposed under the shredding entrance 27 for allowing the plural papers to go through. The shredding knife assembly 30 is disposed in the shredding channel 29 for cutting the plural papers that are transferred through the shredding channel 29. The driving device 31 is disposed within the casing 20. In addition, the driving device 31 is connected with the feeding roller assembly 28, the shredding knife assembly 30 and the thickness detecting device 26 for providing a motive power to the feeding roller assembly 28 and the shredding knife assembly 30. In this embodiment, the driving device 31 is a driving motor. As shown in FIG. 6, the shredding entrance 27 is disposed under the external entrance 211 and in communication with the external entrance 211. The receiving space 201 is disposed under the shredding channel 29. Consequently, the papers outside the upper cover 21 may be transmitted to the receiving space 201 through the external entrance 211, the shredding entrance 27 and the shredding channel 29 sequentially.

Figure 8:
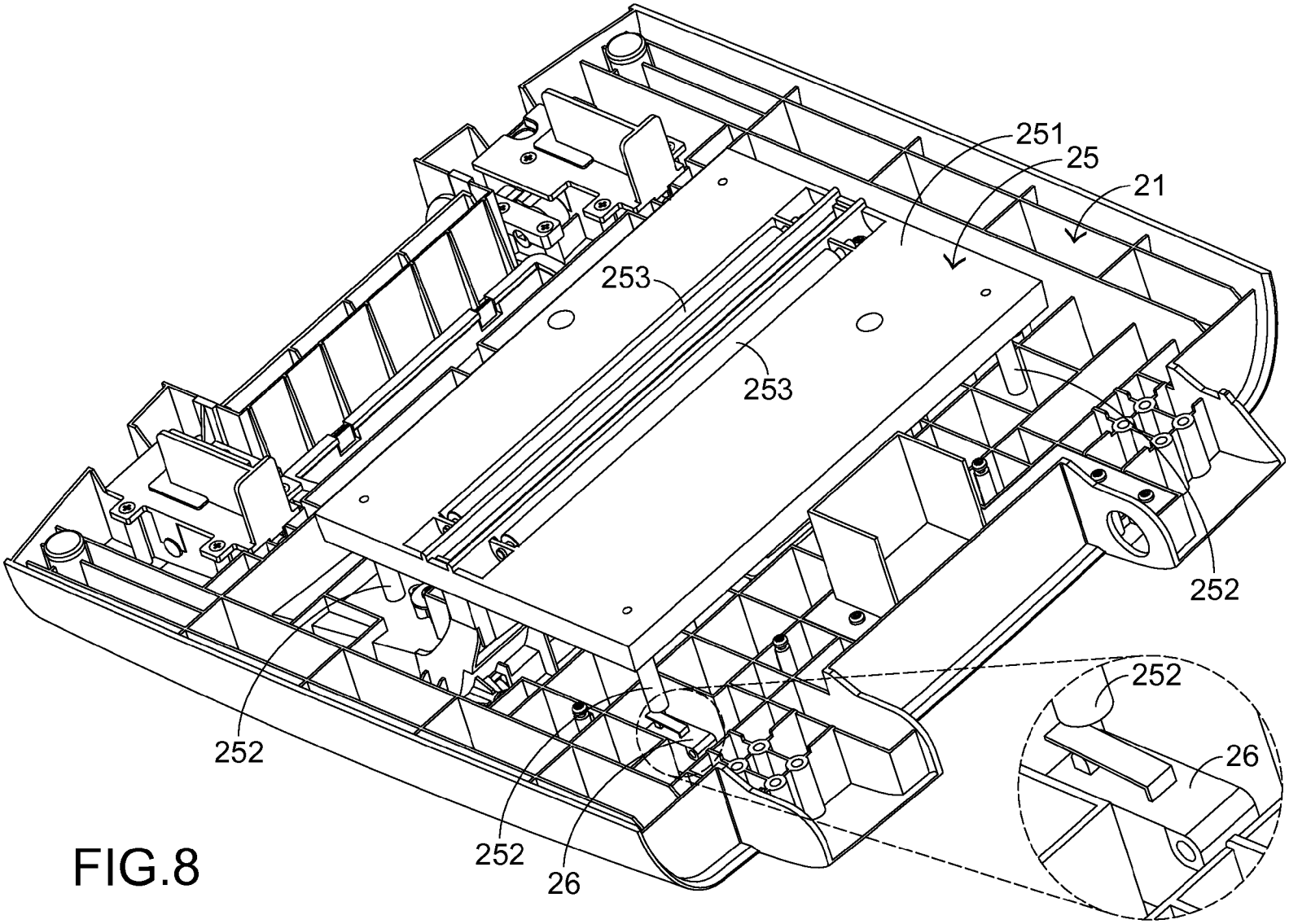
FIG. 8 is a schematic partial perspective view illustrating the upper cover, the pressing member and the thickness detecting device of the paper shredder according to the embodiment of the present invention.

FIG. 8 is a schematic partial perspective view illustrating the upper cover, the pressing member and the thickness detecting device of the paper shredder according to the embodiment of the present invention. Please refer to FIGS. 6 and 8. The pressing member 25 is disposed on a bottom of the upper cover 21. In addition, the pressing member 25 is movable upwardly and downwardly relative to the upper cover 21. When the upper cover 21 is rotated relative to the casing 20 to cover the casing 20, the pressing member 25 is contacted with the plural papers on the input tray 24 and pushed by the plural papers. The pressing member 25 comprises a pressing plate 251, plural connecting posts 252, and an auxiliary roller assembly 253. The pressing plate 251 is disposed under the bottom of the upper cover 21. In addition, the pressing plate 251 may be contacted with the plural papers on the input tray 24 and pushed by the plural papers. The plural connecting posts 252 are disposed on the bottom of the upper cover 21 and connected with the pressing plate 251. When the pressing plate 251 is moved upwardly and downwardly relative to the upper cover 21, the thickness detecting device 26 is triggered by the plural connecting posts 252. The auxiliary roller assembly 253 is disposed on a bottom of the pressing plate 251. The auxiliary roller assembly 253 is contacted with the plural papers that are disposed on the input tray 24. The auxiliary roller assembly 253 is used for assisting the feeding roller assembly 28 in feeding the plural papers. In this embodiment, the plural connecting posts 252 are integrally formed with the pressing plate 251. In addition, the auxiliary roller assembly 253 is an idler roller assembly, which is synchronously rotated with the feeding roller assembly 28.

Please refer to FIG. 8 again. The thickness detecting device 26 is disposed within the upper cover 21, and located near one of the connecting posts 252 of the pressing member 25. The warning module 22 is electrically connected with the thickness detecting device 26. In a case that the overall thickness of the plural papers exceeds a predetermined allowable thickness, the pressing plate 251 of the pressing member 25 is pushed by the plural papers. Consequently, the thickness detecting device 26 is triggered by the connecting post 252 of the pressing member 25 to generate a warning signal. In this embodiment, the thickness detecting device 26 is a micro switch. When the connecting post 252 is pushed to be contacted with the micro switch 26, the micro switch 26 is triggered. In this embodiment, the warning module 22 is an indicating lamp, which is disposed on the casing 20 for generating a warning message. For example, the warning message is a flickering light for prompting the user that the overall thickness of the plural papers exceeds the predetermined allowable thickness. In some other embodiments, the warning module 22 is a display screen or a sound-generating device. Consequently, the warning message is a text message shown on the display screen or a warning sound generated by the sound-generating device.

Hereinafter, the operations of the paper shredder will be illustrated in more details with reference to FIGS. 6 and 8. Firstly, plural papers are placed on the input tray 24, and the upper cover 21 is rotated to have the upper cover 21 cover the casing 20. Meanwhile, the pressing plate 251 at the bottom of the upper cover 21 and the plural papers on the input tray 24 are contacted with each other, and the auxiliary roller assembly 253 and the plural papers on the input tray 24 are also contacted with each other. According to the overall thickness of the plural papers, the pressing plate 251 is pushed by the plural papers and moved toward the upper cover 21. Moreover, as the pressing plate 251 is moved, the plural connecting posts 252 connected with the pressing plate 251 are also moved upwardly.

In a case that the overall thickness of the plural papers on the input tray 24 exceeds the predetermined allowable thickness, the pressing plate 251 and the plural connecting posts 252 have large extents of shifts. Consequently, the corresponding connecting post 252 is contacted with the thickness detecting device 26 to trigger the thickness detecting device 26. When the thickness detecting device 26 is triggered, the thickness detecting device 26 issues a warning signal to the warning module 22. In response to the warning signal generated by the thickness detecting device 26, the warning module 22 generates a warning message. Moreover, in response to the warning signal, the driving device 31 stops providing the motive power to the feeding roller assembly 28 and the shredding knife assembly 30. Consequently, the feeding roller assembly 28 and the shredding knife assembly 30 are disabled. Under this circumstance, the paper shredding operation is stopped in order to protect the paper shredder 2.

In a case that the overall thickness of the plural papers on the input tray 24 does not exceed the predetermined allowable thickness, thickness detecting device 26 is not triggered, and thus the paper shredder 2 is continuously in the normal working status. When casing 20 is covered by the upper cover 21, the plural papers are pushed by the pressing plate 251. In other words, the pressing plate 251 provides a downward force to the plural papers. In response to the downward force, the plural papers and the feeding roller assembly 28 on the input tray 24 can be effectively in close contact with each other. Under this circumstance, since the plural papers can be effectively fed by the feeding roller assembly 28, the possibly of resulting in the idling running action of the feeding roller assembly 28 will be minimized or eliminated. On the other hand, the middle portion of the bottommost paper of the plural papers on the input tray 24 is contacted with the feeding roller assembly 28, and the middle portion of the topmost paper of the plural papers on the input tray 24 is contacted with the auxiliary roller assembly 253. After the feeding roller assembly 28 acquires the motive power from the driving device 31 and thus the feeding roller assembly 28 is rotated, the middle portion of the bottommost paper is firstly introduced into the shredding entrance 27 by the feeding roller assembly 28. Sequentially, an end of the paper (i.e. the front end or the rear end of the paper) is fed by the feeding roller assembly 28 to be moved toward the shredding entrance 27. Then, the end of the paper is introduced into the shredding entrance 27. That is, the middle portion of the paper is firstly introduced into the shredding entrance 27, and then the both ends of the paper are introduced into the shredding entrance 27.

After the plural papers are transferred through the shredding entrance 27, the plural papers are introduced into the shredding channel 29. Consequently, the plural papers are cut into plural small pieces by the shredding knife assembly 30, which is disposed in the shredding channel 29. The plural small pieces fall down toward the lower part of the shredding entrance 27 and then drop into the receiving space 201. The above paper shredding operation is repeatedly done until the plural papers on the input tray 24 are all cut into the plural small pieces. After the paper shredding operation is completed, the user may turn off the paper shedder 2 by operating the plural operating buttons 23.

The present invention further provides another embodiment of a paper shredder with an allowable thickness warning function. In this embodiment, the paper shredder also comprises a casing, an upper cover 41 (see FIG. 9), a warning module, plural operating buttons, a pressing member 45 (see FIG. 9), a thickness detecting device 46 (see FIG. 9), a shredding entrance, a feeding roller assembly, a shredding channel, a shredding knife assembly, and a driving device. Except for the following items, the structures and functions of other components are substantially identical to those of the above embodiment, and are not redundantly described herein. Hereinafter, only the differences between these two embodiments will be illustrated.

Figure 9:
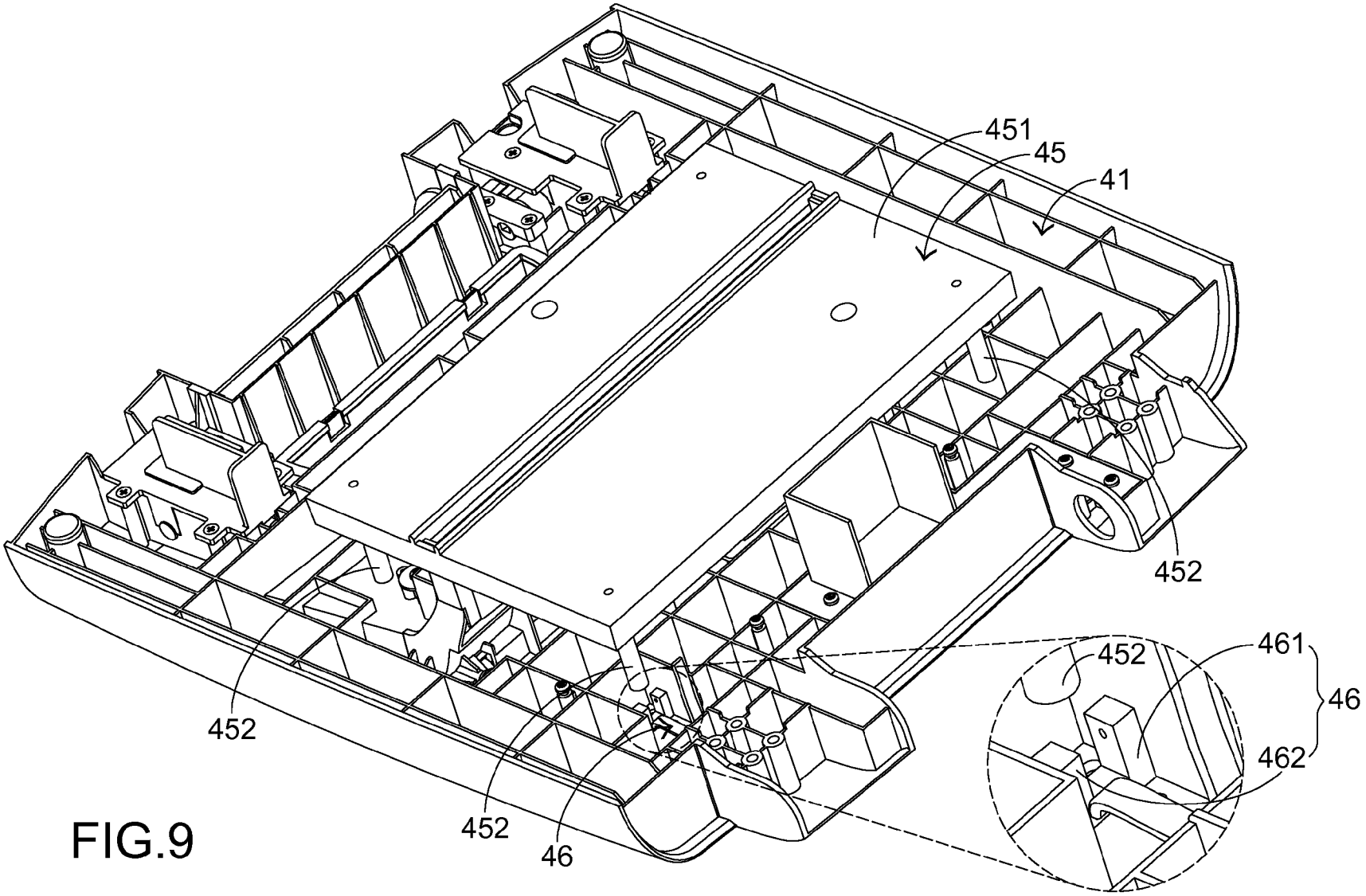
FIG. 9 is a schematic partial perspective view illustrating the upper cover, the pressing member and the thickness detecting device of the paper shredder according to another embodiment of the present invention.

FIG. 9 is a schematic partial perspective view illustrating the upper cover, the pressing member and the thickness detecting device of the paper shredder according to another embodiment of the present invention. The pressing member 45 is disposed on a bottom of the upper cover 41. In addition, the pressing member 45 is movable upwardly and downwardly relative to the upper cover 41. The pressing member 45 comprises a pressing plate 451 and plural connecting posts 452. The pressing plate 451 is disposed under the bottom of the upper cover 41. In addition, the pressing plate 451 may be contacted with the plural papers on the input tray and pushed by the plural papers. The plural connecting posts 452 are disposed on the bottom of the upper cover 41 and connected with the pressing plate 451. When the pressing plate 451 is moved upwardly and downwardly relative to the upper cover 41, the thickness detecting device 46 is triggered by the plural connecting posts 452. In comparison with the pressing member 25 of the paper shredder of the above embodiment, the pressing member 45 of this embodiment has no auxiliary roller assembly.

Please refer to FIG. 9 again. The thickness detecting device 46 is disposed on the upper cover 41, and located near one of the connecting posts 452 of the pressing member 45. When the thickness detecting device 46 is pressed by the connecting posts 452 of the pressing member 45, the thickness detecting device 46 is triggered to generate a warning signal. In this embodiment, the thickness detecting device 46 comprises a light emitter 461 and a light receiver 462. The light emitter 461 is located at a first side of the connecting post 452 for generating a light beam (not shown). The light receiver 462 is located at a second side of the connecting post 452 for receiving a light beam. When the connecting post 452 is pushed and inserted into the region between the light emitter 461 and the light receiver 462, the light beam is hindered by the connecting post 452. Under this circumstance, the light receiver 462 fails to receive the light beam, and thus the light receiver 462 issues a warning signal.

From the above discussions, the paper shredder of this embodiment is distinguished from the above embodiment by the following two items. Firstly, the pressing member 45 of this embodiment is not equipped with the auxiliary roller assembly, and the pressing plate 451 of the pressing member 45 provides a downward force to the plural papers on the input tray. Secondly, the thickness detecting device 46 of this embodiment is an optical sensor.

From the above two embodiments, the present invention provides a paper shredder with an allowable thickness warning function. The thickness detecting device is disposed within the upper cover for detecting the overall thickness of the plural papers on the input tray. In a case that the overall thickness of the plural papers exceeds the predetermined allowable thickness, the paper shredder issues a warning message to prompt the user, and the paper shredder is disabled at the same time. Since the user can realize whether the overall thickness of the plural papers exceeds the maximum allowable thickness of the input tray, the paper shredder will not be erroneously operated, and the paper shredder can be effectively protected.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A paper shredder with an allowable thickness warning function for cutting plural papers, said paper shredder comprising:

a casing;

an input tray disposed on said casing for placing said plural papers thereon;

a shredding entrance disposed in said casing and located at a bottom of said input tray, wherein said plural papers on said input tray are introduced into said casing through said shredding entrance;

an upper cover disposed over said casing, and rotatable relative to said casing;

a pressing member disposed on a bottom of said upper cover and movable upwardly and downwardly relative to said upper cover, wherein when said upper cover is rotated relative to said casing to cover said casing, said pressing member is contacted with said plural papers on said input tray and said pressing member is pushed by said plural papers; and a thickness detecting device disposed within said upper cover and located near said pressing member, wherein if an overall thickness of said plural papers exceeds an allowable thickness, said pressing member is pushed by said plural papers, so that said thickness detecting device is triggered by said pressing member to generate a warning signal.

2. The paper shredder according to claim 1, further comprising a warning module, wherein said warning module is electrically connected with said thickness detecting device, wherein in response to said warning signal, said warning module generates a warning message.

3. The paper shredder according to claim 2, wherein said warning module is an indicating lamp, a display screen or a sound-generating device, wherein said warning message is a flickering light generated by said indicating lamp, a text message shown on said display screen or a warning sound generated by said sound-generating device.

4. The paper shredder according to claim 1, wherein said pressing member comprises:

a pressing plate disposed under said bottom of said upper cover to be contacted with said plural papers on said input tray and pushed by said plural papers; and at least one connecting post disposed on said bottom of said upper cover and connected with said pressing plate, wherein said pressing plate is movable upwardly and downwardly relative to said upper cover to trigger said thickness detecting device.

5. The paper shredder according to claim 4, wherein said thickness detecting device is a micro switch.

6. The paper shredder according to claim 4, wherein said thickness detecting device comprises:

a light emitter located at a first side of said at least one connecting post for generating a light beam; and a light receiver located at a second side of said at least one connecting post for receiving said light beam.

7. The paper shredder according to claim 1, further comprising:

a shredding channel disposed under said shredding entrance for allowing said plural papers to go through;

a feeding roller assembly located at bilateral sides of said shredding entrance, wherein when said feeding roller assembly is contacted with said plural papers on said input tray, said plural papers are fed into said shredding entrance by said feeding roller assembly;

a shredding knife assembly disposed in said shredding channel for cutting said plural papers which are transferred through said shredding channel; and a driving device disposed within said casing and connected with said feeding roller assembly, said shredding knife assembly and said thickness detecting device for providing a motive power to said feeding roller assembly and said shredding knife assembly.

8. The paper shredder according to claim 7, wherein when said thickness detecting device is triggered to generate said warning signal, said driving device stops providing said motive power in response to said warning signal, so that said feeding roller assembly and said shredding knife assembly are disabled.

9. The paper shredder according to claim 7, wherein a middle portion of a bottommost paper of said plural papers on said input tray is contacted with said feeding roller assembly, wherein after said feeding roller assembly is rotated by acquiring said motive power, said middle portion of said bottommost paper is firstly introduced into said shredding entrance by said feeding roller assembly, then an end of said bottommost paper is fed by said feeding roller assembly to be moved toward said shredding entrance, and finally said end of said bottommost paper is introduced into said shredding entrance.

10. The paper shredder according to claim 7, wherein said casing further comprising:

a receiving space disposed under said shredding channel, wherein said plural papers are cut into plural small pieces, wherein a storage box for storing said small pieces of said cut papers, said storage bag for storing said small pieces of said cut papers or said small pieces of said cut papers are accommodated within said receiving space; and a door disposed on said casing, wherein by rotating said door relative to said casing, said receiving space is selectively exposed or unexposed.

11. The paper shredder according to claim 7, wherein said upper cover comprises an external entrance, which is exposed outside said upper cover, wherein at least one paper of said plural papers outside said upper cover is introduced into said shredding entrance through said external entrance.

* * * * *